US006230821B1

(12) United States Patent
Warren et al.

(10) Patent No.: US 6,230,821 B1
(45) Date of Patent: May 15, 2001

(54) WEIGHT CONTROL SYSTEM FOR A ROTARY DRILL ASSEMBLY

(75) Inventors: Jasper Newton Warren, Houston; Larry R. Forney, Fresno, both of TX (US)

(73) Assignee: Goldrus Producing Company, Houston, TX (US)

( * ) Notice: Subject to any disclaimer, the term of this patent is extended or adjusted under 35 U.S.C. 154(b) by 0 days.

(21) Appl. No.: 09/303,175

(22) Filed: Apr. 30, 1999

Related U.S. Application Data

(60) Provisional application No. 60/083,746, filed on Apr. 30, 1998.

(51) Int. Cl.[7] ..... E21B 44/00
(52) U.S. Cl. ..... 175/27; 175/317
(58) Field of Search ..... 175/27, 317, 57

(56) References Cited

U.S. PATENT DOCUMENTS

| | | | | |
|---|---|---|---|---|
| 3,550,697 | * | 12/1970 | Hobhouse | 175/26 |
| 3,648,783 | * | 3/1972 | Lackey | 173/4 |
| 4,660,656 | * | 4/1987 | Warren et al. | 175/26 |
| 5,806,611 | * | 9/1998 | Van Den Steen et al. | 175/27 |

* cited by examiner

*Primary Examiner*—Thomas B. Will
*Assistant Examiner*—Meredith C. Petravick
(74) *Attorney, Agent, or Firm*—Jenkens & Gilchrist

(57) ABSTRACT

A system for controlling the weight on a rotary drill bit includes an hydraulic cylinder and piston assembly. Pressurized hydraulic fluid acting on the bottom of the piston provides an upward force on the drill string which is connected to the rotary drill bit. A profiled central drive shaft running through the piston conveys the rotary motion from a power swivel to a piston rod attached to the bottom of the piston which in turn is connected to the drill string.

8 Claims, 4 Drawing Sheets

WEIGHT CONTROL SYSTEM FOR A ROTARY DRILL ASSEMBLY

This application claims the benefit of U.S. Provisional Patent Application Ser. No. 60/083,746, filed Apr. 30, 1998.

FIELD

The present invention pertains to drilling rigs; more particularly, the present invention pertains to an apparatus used to control the force on a drill bit which is operated by a drilling rig.

BACKGROUND

In operations involving the drilling of vertical, directional, or horizontal wells, there is a need for accurately controlling the weight of the drill string on a drill bit.

The need to accurately control the weight of the drill string on the rotary drill bit is particularly critical when drilling either directional or horizontal wells. In directional or horizontal wells, the weight on the drill bit affects the angular deviation of the drilled hole away from the vertical. By obtaining an accurate time measurement of the duration of travel of the rotary drill bit within the well bore, together with providing a way of accurately limiting the loads that drillers can place on a rotary drill assembly, it is possible to execute delicate and sophisticated drilling operations while minimizing down hole tool failures and maximizing the life of the rotary drill bit.

While a variety of complex systems have been proposed for controlling the weight on a rotary drill bit, the need remains for a simple, easy-to-use, easy-to-maintain system that allows drillers to execute delicate and sophisticated drilling operations while at the same time minimizing down hole tool failures and maximizing the life of expensive drill bit assemblies.

SUMMARY

The simple easy-to-use, and easy-to-maintain drill bit weight control system of the present invention allows drillers to execute delicate and sophisticated drilling operations while minimizing down hole tool wear and maximizing drill bit life. The disclosed invention provides a controllable upward force on a drill string while at the same time enabling rotation of the drill string within the well bore. The controllable upward force is provided by a piston and cylinder assembly which is interposed between the power swivel, which provides rotary force for tuning the drill string, and the top of the drill string. The drill string is connected to the bottom of the piston which is slidable within the cylinder assembly. A hydraulic pressure system provides force on the bottom surface of the piston so that the piston will provide an upward force on the drill string. A profiled Kelly drive shaft extends through the piston and the downwardly extending piston rod. The profiled Kelly drive shaft provides rotary force from the power swivel to the drill string.

DESCRIPTION OF THE DRAWING FIGURES

A better understanding of the rotary drill bit weight control system 10 of the present invention may be had to reference to the drawing figures wherein.

DESCRIPTION OF THE EMBODIMENTS

Figure 7:
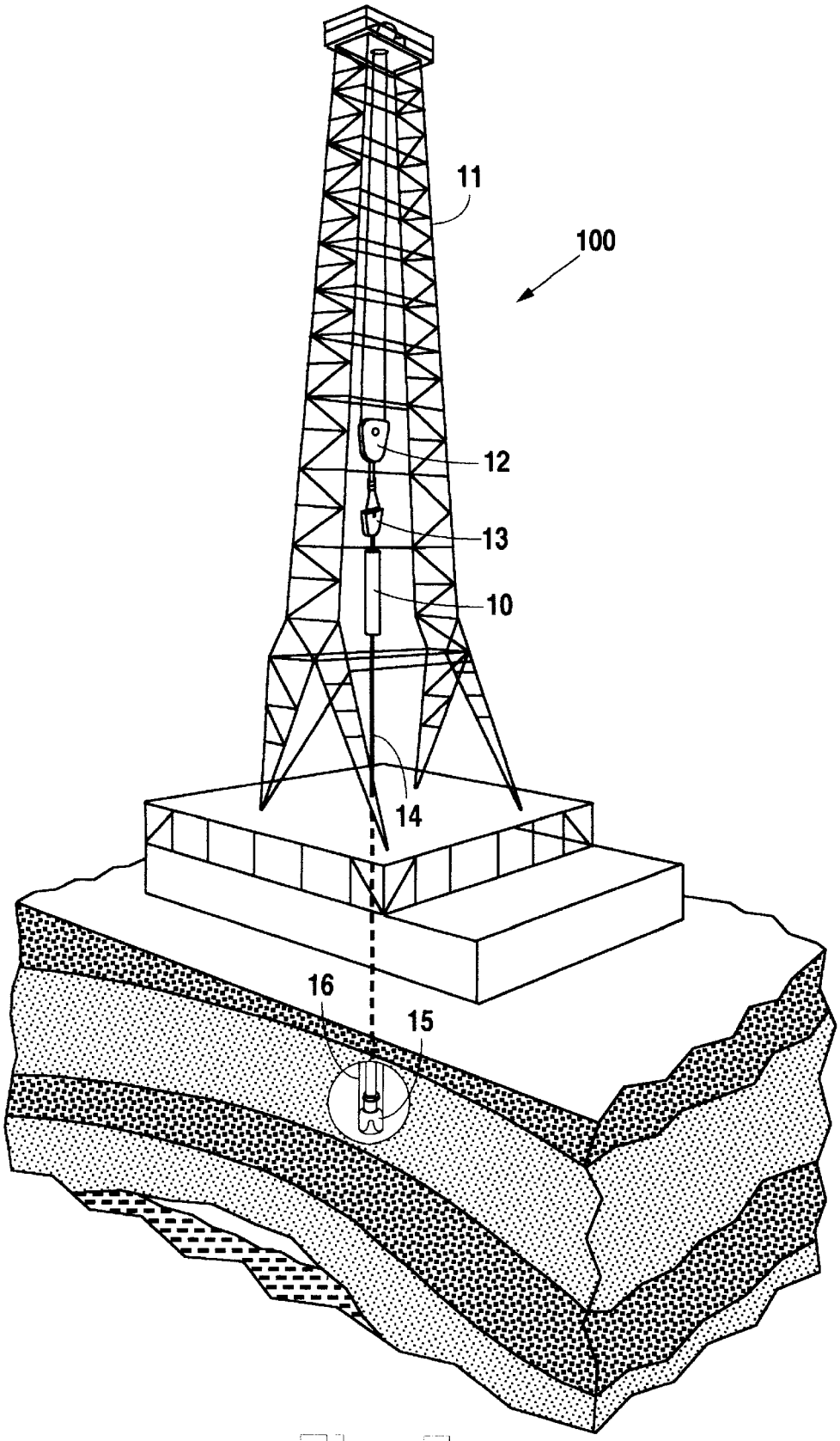
FIG. 7 is a perspective view of a drilling rig assembly incorporating the rotary drill bit weight control system of the present invention.

As shown in FIG. 7 the rotary drill bit weight control system of the present invention is interposed between a power swivel 13 and the top of a drill string 14. In a typical drilling assembly 100, the power swivel is supported by a hoist 12 which hangs from a derrick 11. The purpose of the present invention is to enable accurate control of the weight placed on the rotary drill bit 15 at the bottom of the well bore 16 by its mechanical connection at the bottom of the drill string 14. In addition, the rotary chill bit weight control system 10 of the present invention conveys the rotary motion imparted by the power swivel 13 on the drill string 14 to rotate the rotary drill bit 15 within the well bore 16.

In its most simplified form, the rotary drill bit weight control system 10 of the present invention is a controllable hydraulic spring which is placed between the bottom of the power swivel 13 and the top of the drill string 14. Pressurized hydraulic fluid from a controllable system 130 (FIG. 6) is used to control the upward force on the drill string 14. Further included within the rotary drill bit weight control system 10 of the present invention is a central passage which allows for drilling fluid to move through the rotary drill bit weight control system 10, through the drill string 14, and to the rotary drill bit 15 at the bottom of the well bore 16. By the sealing engagement of the sliding parts within the rotary drill bit weight control system 10 of the present invention the drilling fluid is kept entirely separate and apart from the hydraulic fluid which provides an upward force on the piston 70 within the cylinder assembly 20, which upward force is transmitted by a piston rod 80, which is connected to the main piston 70, to the drill string 14.

Figure 1:
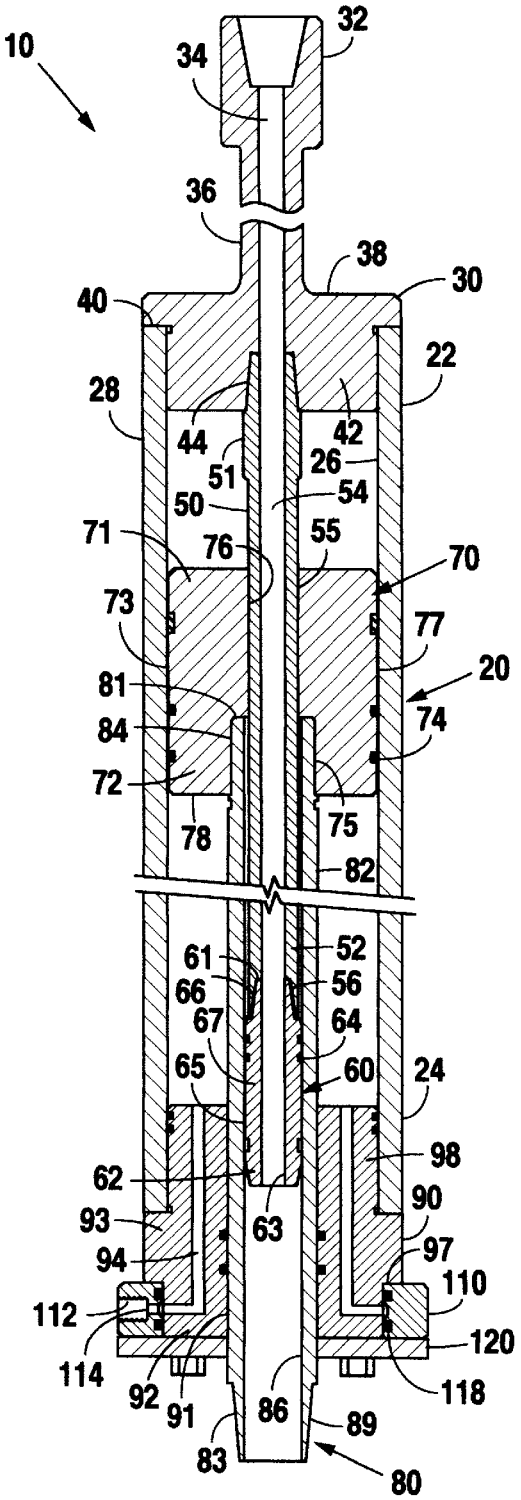
FIG. 1 is a front elevational view in partial section of the rotary drill bit weight control system of the present invention with the piston near the top of its stroke.
Figure 2:
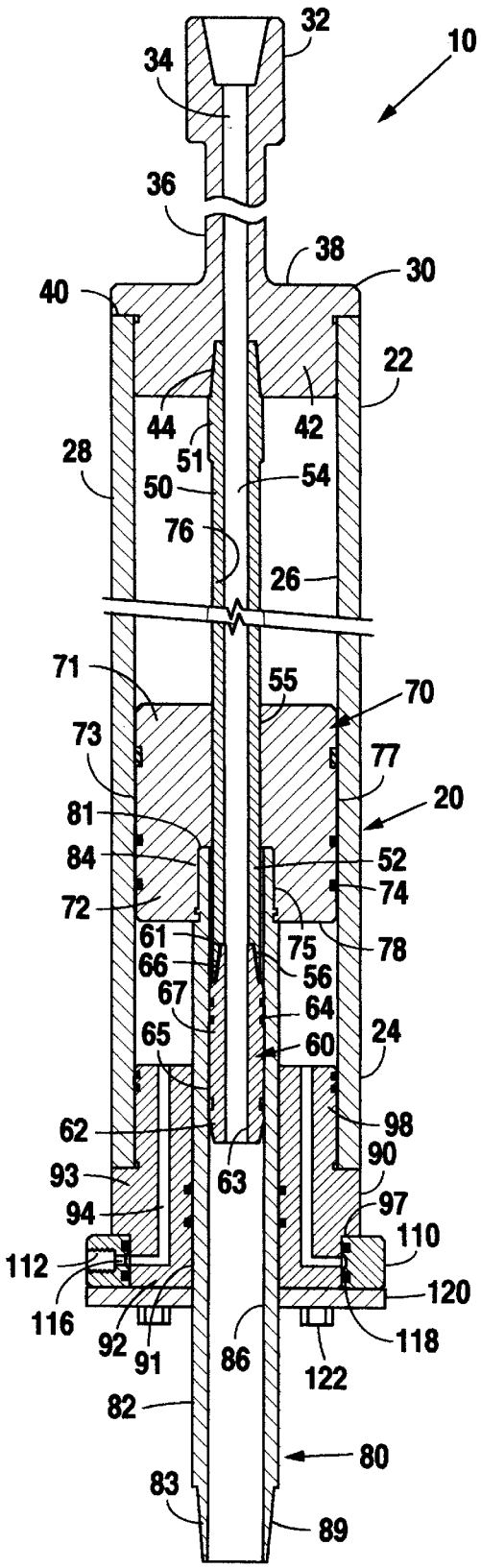
FIG. 2 is a side elevational view in partial section similar to FIG. 1 showing the downward displacement of the piston.
Figure 3:
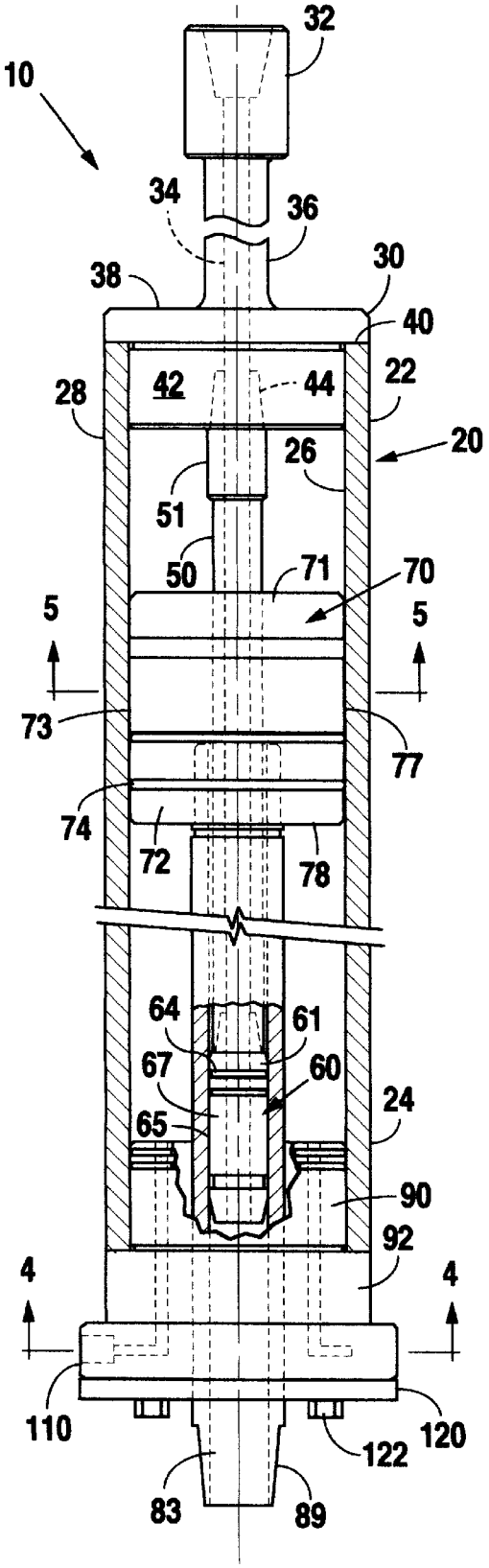
FIG. 3 is a view similar to FIG. 1.

As may be seen in FIGS. 1, 2 and 3, the cylinder assembly 20 is closed on its upper end 22 by an upper hollow plug assembly 30 and on its bottom end 24 by a lower hollow plug assembly 90. The upper hollow plug assembly 30 includes threadable means 32 for attaching to a power swivel 13. Extending downwardly from the bottom of the means for attaching to a power swivel 32 is a neck portion 36. Passing through the neck portion 36 is a central bore 34 for the passage of drilling fluid. At the bottom of the neck 36 is a lower cylindrical section 38. The lower cylindrical section 38 includes a shoulder 40 which engages the top end 22 of the cylinder assembly 20. Beneath the shoulder 40 is a narrowed portion 42 which engages the inside surface 26 of the top of the cylinder assembly 20. At the center of the narrowed portion 42, beneath the lower cylindrical section 38 of the upper hollow plug assembly 30, is located threadable means 44 for engaging the profiled Kelly drive shaft assembly 50.

The profiled Kelly drive shaft assembly 50 includes a top end 51 which includes threadable means 53 for engaging corresponding threads 44 at the bottom of the upper hollow plug assembly 30. On the bottom end 52 of the profiled Kelly drive shaft 50, is located means for engaging a hollow sealing piston assembly 60. The surface of the central portion 55 of the profiled Kelly drive shaft assembly 50 engages the bore 76 within the main piston assembly 70.

Passing through the profiled Kelly drive shaft assembly 50 is a central bore 54 for conducting drilling fluid through the Kelly drive shaft assembly 50 to the rotary drill bit 15 at the bottom of the drill string 14.

Threadably engaging the bottom end 52 of the profiled Kelly drive shaft assembly 50 is a hollow sealing piston assembly 60. The hollow sealing piston assembly 60 includes a means for engaging 66 the profiled Kelly drive shaft 50 at its upper end 61. In the central portion 67 of the hollow sealing piston assembly 60 are located a plurality of O-ring seals 64 which engage the central bore 86 within the piston rod assembly 80. The central bore 63 within the sealing piston assembly 60 allows for the passage of drilling fluid from the bottom 62 of the hollow sealing piston assembly 60 into the profiled central bore 86 of the piston rod assembly 80, thence into the drill string 14 and on to the rotary drill bit 15.

The main piston assembly 70 has a top end 71, a bottom end 72, and a central bore 76. The central bore 76 is shaped to engage the outer surface of the central portion 55 of the profiled Kelly drive shaft assembly 50. O-ring assemblies 74 are included on the outer surface 73 of the main piston assembly 70. On the bottom 72 of the main piston assembly 70 are threadable means 75 for engaging the piston rod assembly 80.

The piston rod assembly 80 includes a top end 81, a bottom end 83, and a central portion 82. The top end 81 includes threadable means for engaging the bottom 62 of the piston assembly 60 and the bottom end 83 includes threadable means 89 for engaging the drill string 14. Passing through the piston rod assembly 80 is a profiled central bore 86 which engages the outer surface 65 of the hollow sealing piston assembly 60. The bottom end 83 of the piston rod assembly 80 is sized to engage the interior bore 91 of the bottom plug assembly 90.

The bottom plug assembly 90 includes a top portion which has a narrowed portion 98 sized to engage the inner surface 26 of the cylinder assembly 20. At the bottom of this narrowed section is a shoulder 97 which engages the bottom edge of the cylinder assembly and has an outer diameter approximately equal to the outer diameter 28 of the cylinder assembly 20. Passing through the central portion 93 of the hollow bottom plug assembly 90 is a passageway 94 for hydraulic fluid.

Surrounding the bottom of the hollow bottom plug assembly 90 is a stationary ring 110. The bottom 92 of the hollow bottom plug assembly 90 rotates within this stationary ring 110. As may be best seen in FIGS. 1 and 2, the stationary ring 110 includes a threaded connection 112 which may be used to for attachment to the hydraulic pressure system 130 shown in FIG. 6. Extending from the threaded connection is a fluid passage 114 which engages a fluid gallery 116 at its bottom end. A sealing connection with the bottom of the hollow bottom plug assembly is provided by O-ring assemblies 118 at the inner edge of the stationary ring 110. Holding the stationary ring assembly 110 in position is a bottom plate 120 which is attached by threaded fasteners 122 to the bottom 92 of the hollow bottom plug assembly 90.

OPERATION

Figure 4:
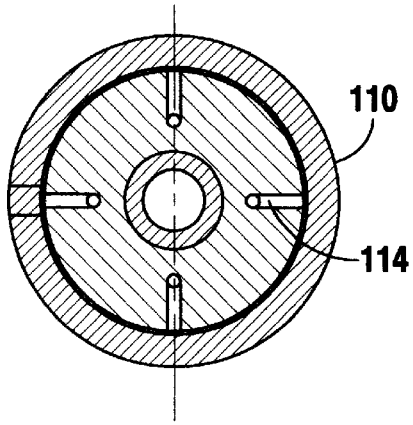
FIG. 4 is a sectional view taken at line 4—4 of FIG. 3.
Figure 5:
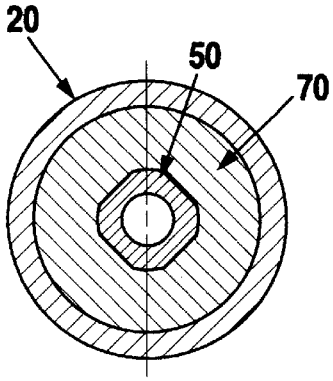
FIG. 5 is a sectional view taken at line 5—5 of FIG. 3.
Figure 6:
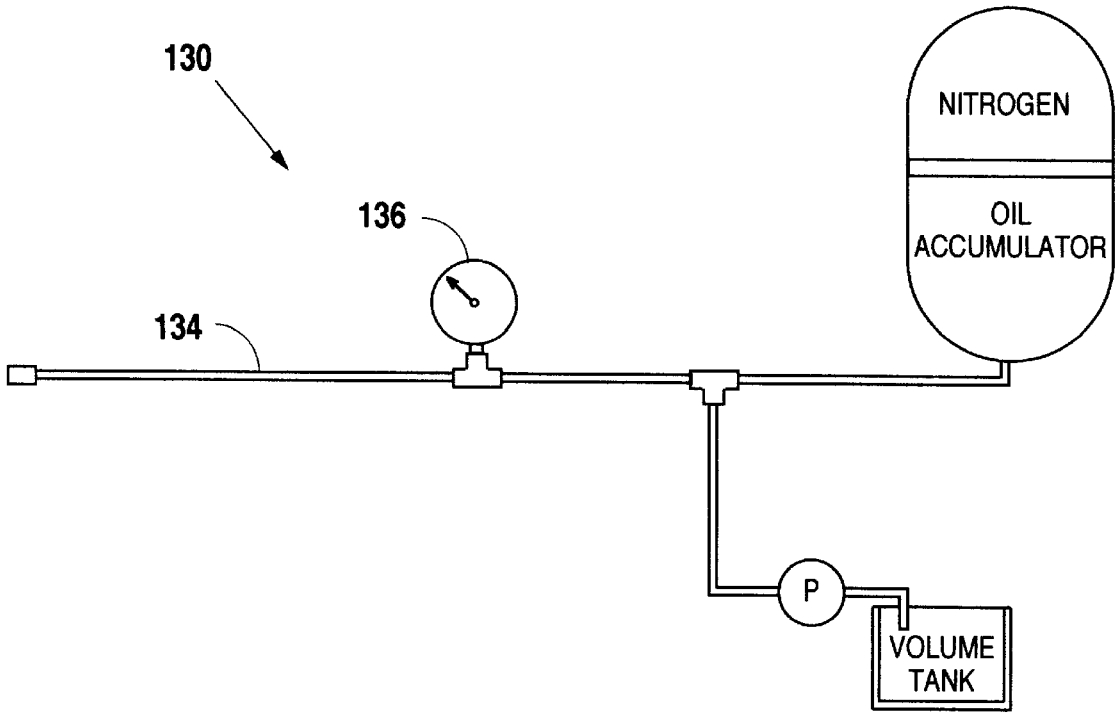
FIG. 6 is a schematic view of the hydraulic fluid pressure control system.

The fluid pressure of the hydraulic fluid obtained from the hydraulic system 130 depicted in FIG. 6, and adjusted by controlling the pressure of the pressure of the fluid by pressure control valve P, is adjusted according to the pressure gauge 136 connected by tubing 134 to the stationary ring 110. As shown in FIG. 4 the stationary ring 110 enables the passage of pressurized hydraulic fluid into the fluid passageways 114 in the hollow bottom plug assembly 90. By controlling the pressure within the cylinder assembly 120, it is possible to control the position of the main piston 70 within the bore of the cylinder assembly 20 as shown by a comparison between FIGS. 1 and 2. When the piston 70 is moved within the main cylinder assembly 20, it passes along the exterior surface of the profiled Kelly drive shaft 50 in its central bore 76 and within the inner surface 26 of the cylinder assembly 20 on its exterior surface 77. By adjusting the position of the main piston 70 within the cylinder assembly 20, it is possible to precisely adjust the amount of contact between the rotating drill bit 15 and the bottom of the well bore 16. This precise adjustment of the amount of contact between the rotating drill bit 15 and the bottom of the well bore 16 enables the driller to adjust the weight placed on the drill bit 15. Thus, the weight of the drill string 14 is primarily supported by the hydraulic fluid pressure within the cylinder assembly 20 acting on the bottom surface 72 of the main piston 70.

When the power swivel 13 imparts rotary force to the drill bit control system 10 of the present invention all parts rotate except for the stationary ring 110 which is connected to the hydraulic fluid pressure assembly 130. Turning torque from the power swivel 13 is transferred to the drill string 14 by the engagement of the profiled Kelly drive shaft assembly 50 with the inside of the main piston assembly 70 and the engagement of the hollow sealing piston assembly 60 with the profiled central bore 88 within the piston rod assembly 80.

For most installations, it has been found that the piston rod assembly 80 should be designed to withstand 75,000 lbs. of tensile load with less than 3,000 psi hydraulic pressure on the bottom surface 78 of the main piston 70. Suitable travel of the piston rod assembly 80 has been accomplished by a system whose overall length is approximately 21 feet. A 21 foot length will allow for about 16 feet of piston stroke within the cylinder assembly 20. Internal circulation pressures of drill fluid of about 15,000 psi will be obtainable if necessary to facilitate drilling operations. It has been found that the system 10 will provide a variable weight on the drill bit 15 which is accurate to 100 lbs. and will also provide "creeping" movements of the drill bit 15 if desired. Further, the rate of piston 70 travel through the cylinder assembly 20 can be actually measured by an ultrasonic device or other suitable measuring system.

While the present invention has been illustrated and discussed by reference to its preferred embodiment, those of ordinary skill in the art will understand that the rotary drill bit weight control system of the present invention may embody a variety of different forms and configurations. Such different forms and alterations shall fall within the scope and meaning of the appended claims.

What is claimed is:

1. A system for controlling the downward weight on a drill bit at the end of a drill string and suspended from a power swivel, said system being located between the power swivel and the drill string, said system comprising:

means for transmitting rotary motion from the power swivel to the drill string;

means for connecting said power swivel to said drill string; said means for connecting the power swivel to the drill string further including means for imparting an adjustable upward force on the drill string to reduce the downward weight on the drill bit.

2. The system as defined in claim 1 wherein in said means for transmitting rotary motion from the power swivel to the drill string is a profiled drive shaft which sealingly engages a correspondingly profiled bore in a hollow piston rod connected to the drill string.

3. The system as defined in claim 1 wherein said means for imparting an adjustable force on the drill string is a piston sliding within a hollow cylinder, wherein said piston is connected to said hollow piston rod.

4. The system as defined in claim 3 further including means for conducting pressurized hydraulic fluid to said piston to place an upward force on the bottom of said piston.

5. A system for controlling the weight on a drill bit located at the end of a drill string and suspended from a power swivel, said system constructed and arranged to be located between the power swivel and the drill string, said system comprising:

a cylinder assembly having an upper end, a lower end, and a hollow central portion;

said cylinder assembly enclosed at said upper end by a hollow upper plug and at said lower end by a hollow lower plug;

said hollow upper plug including means for attaching to the power swivel and means for engaging said upper end of said hollow cylinder assembly;

said hollow lower plug including at least one passage way for conducting hydraulic fluid to said hollow central portion of said cylinder assembly and means for engaging said lower end of said hollow cylinder assembly;

a hollow main piston constructed and arranged to travel within said hollow central portion of said cylinder assembly;

a hollow piston rod constructed and arranged to engage said hollow main piston, to sealingly engage the hollow portion of said hollow lower plug, and to engage the top of the drill string;

said hollow piston rod having a profiled central bore;

a profiled hollow sealing piston constructed and arranged to sealingly engage said profiled central bore of said hollow piston rod;

a profiled central drive shaft constructed and arranged to engage said profiled hollow sealing piston at one end, to engage said hollow main piston in its central portion, and engage said hollow upper plug at the opposite end;

means for providing hydraulic fluid to said hollow lower plug;

whereby the weight on the drill bit may be controlled by the pressure of said hydraulic fluid on said hollow main piston.

6. A drill string comprising:

a rotary drill bit connected to a rotatable drill string;

said rotatable drill string including a plurality of sections of drill pipe or tubing;

a power swivel connected to said rotatable drill string;

a system for controlling the downward weight on said rotary drill bit, said system constructed and arranged to be located between said power swivel and said rotatable drill string, said system including:

means for transmitting rotary motion from the power swivel to the drill string;

means for connecting said power swivel to said drill string;

said means for connecting said power swivel to said drill string further including means for imparting an adjustable upward force on the drill string to reduce the downward weight on said rotary drill bit.

7. A well drilling apparatus comprising:

a derrick, said derrick positioned over said well being drilled;

a lifting hoist connected to said derrick;

a power swivel connected to said lifting hoist;

a rotary drill bit connected to a rotatable drill string, said rotatable drill string including a plurality of sections of drill pipe or tubing;

said power swivel constructed and arranged to provide rotary force to said rotatable drill;

a system for controlling the weight on said rotary drill bit;

said system for controlling the weight on said rotary drill bit constructed and arranged to be located between said power swivel and said rotatable drill string;

said system for controlling the weight on said rotary drill bit including:

means for transmitting rotary motion from the power swivel to said drill string;

means for connecting said power swivel to said drill string;

said means for connecting said power swivel to said drill string further including means for imparting an adjustable upward force on said drill string to reduce the downward weight on said rotary drill bit.

8. A device for controlling the weight on a rotary drill bit, said device comprising:

hollow means for attaching to a power swivel;

a main piston, piston rod, and cylinder assembly connected to said hollow means for attaching to a power swivel;

said cylinder assembly further including an upper hollow end and a lower hollow end;

a hollow profiled Kelly drive shaft constructed and arranged to threadably engage said upper hollow end of said cylinder assembly;

said main piston being constructed and arranged to sealingly engage and travel through the bore of said cylinder assembly by the force of hydraulic pressure on its bottom surface;

said main piston further including a profiled central bore constructed and arranged to engage said hollow profiled Kelly drive shaft;

said piston rod including a central passage for housing said hollow profiled Kelly drive shaft;

said hollow profiled Kelly drive shaft terminating in a hollow sealing piston which engages the inside diameter of said central passage through said piston rod;

said piston rod being mechanically connected to the drill bit by a drill string;

a hydraulic fluid inlet ring constructed and arranged to be rotatable about said lower hollow end of said cylinder assembly;

a source of hydraulic fluid pressure;

said main piston, piston rod, and cylinder assembly constructed and arranged to form a fluid path from said source of hydraulic fluid pressure through said rotatable hydraulic inlet ring, through said lower hollow stationary end of said cylinder assembly, between the exterior of said piston rod and the interior walls of said cylinder assembly to the bottom of said main piston;

whereby hydraulic fluid pressure on the bottom of said main piston will create a tension force on said piston rod which tension force controls the weight on the drill bit by adjusting the hydraulic pressure on the bottom of said main piston; and a path for drilling fluid through said hollow means for attaching to a power swivel, said upper hollow stationary end, said hollow profiled Kelly drive, said hollow sealing piston, and said piston rod.

* * * * *